US011214029B2

(12) United States Patent
Huang et al.

(10) Patent No.: US 11,214,029 B2
(45) Date of Patent: Jan. 4, 2022

(54) ENERGY-SAVING DOUBLE-MOTOR DOUBLE-STATION SCREW PRESS

(71) Applicant: HEFEI UNIVERSITY OF TECHNOLOGY, Hefei (CN)

(72) Inventors: Haihong Huang, Hefei (CN); Rui Jin, Hefei (CN); Lei Li, Hefei (CN); Bo Fang, Hefei (CN); Zhifeng Liu, Hefei (CN)

(73) Assignee: HEFEI UNIVERSITY OF TECHNOLOGY, Hefei (CN)

( * ) Notice: Subject to any disclaimer, the term of this patent is extended or adjusted under 35 U.S.C. 154(b) by 88 days.

(21) Appl. No.: 16/799,754

(22) Filed: Feb. 24, 2020

(65) Prior Publication Data

US 2020/0189220 A1 Jun. 18, 2020

Related U.S. Application Data

(63) Continuation of application No. PCT/CN2019/078683, filed on Mar. 19, 2019.

(30) Foreign Application Priority Data

Apr. 12, 2018 (CN) ..... 201810326690.8

(51) Int. Cl.
*B30B 1/18* (2006.01)

(52) U.S. Cl.
CPC ..... *B30B 1/186* (2013.01)

(58) Field of Classification Search
CPC ..... B30B 1/18; B30B 1/181; B30B 1/186; B30B 1/23; B30B 9/3064
See application file for complete search history.

(56) References Cited

U.S. PATENT DOCUMENTS 3,352,230 A * 11/1967 Hunnicutt ..... B30B 9/3064 100/345
3,768,398 A * 10/1973 Ullman, Jr. ..... B30B 9/3007 100/45

(Continued)

FOREIGN PATENT DOCUMENTS

CN 101011866 A 8/2007
CN 201141425 Y 10/2008

(Continued)

OTHER PUBLICATIONS

The International Search Report of corresponding International application No. PCT/CN2019/078683, dated Jun. 19, 2019.

(Continued)

*Primary Examiner* — Matthew Katcoff
(74) *Attorney, Agent, or Firm* — J.C. Patents

(57) ABSTRACT

Disclosed is a double-motor double-station screw press, comprising two sets of screw pair mechanisms on both sides thereof, i.e., first and second screw pair mechanisms, where in the first screw pair mechanism, a first lead screw is driven by a resultant movement synthesized by first and second motors through a first differential gear train; in the second screw pair mechanism, a second lead screw is driven by a resultant movement synthesized by the first and second motors through a second differential gear train; a first slider and a second slider in the press work symmetrically; a transmission mode between the second motor and the second differential gear train is switched by controlling a steering switching apparatus, such that the second motor can assist the first motor during a single-cylinder pressing process to increase the output pressure, but also it is convenient to adjust a relative positions of two cylinders.

6 Claims, 1 Drawing Sheet

(56) References Cited

U.S. PATENT DOCUMENTS

| | | | | |
|---|---|---|---|---|
| 3,867,880 | A * | 2/1975 | Bourgeois | B30B 9/3064 100/226 |
| 7,370,681 | B2 * | 5/2008 | Lee | B30B 1/18 156/351 |
| 2003/0188644 | A1 * | 10/2003 | Winter | B30B 15/0094 100/280 |
| 2016/0221217 | A1 * | 8/2016 | Lunstedt | B30B 11/02 |

FOREIGN PATENT DOCUMENTS

| | | | |
|---|---|---|---|
| CN | 103358577 | A | 10/2013 |
| CN | 105531104 | A | 4/2016 |
| CN | 107695270 | A | 2/2018 |
| CN | 108381962 | A | 8/2018 |
| JP | H11-58091 | A | 3/1999 |
| JP | 3237938 | B1 | 11/2017 |
| WO | 2015/056469 | A1 | 4/2015 |

OTHER PUBLICATIONS

The Chinese First Examination Report and Search Report of corresponding Chinese application No. 201810326690.8, dated May 8, 2019.

* cited by examiner

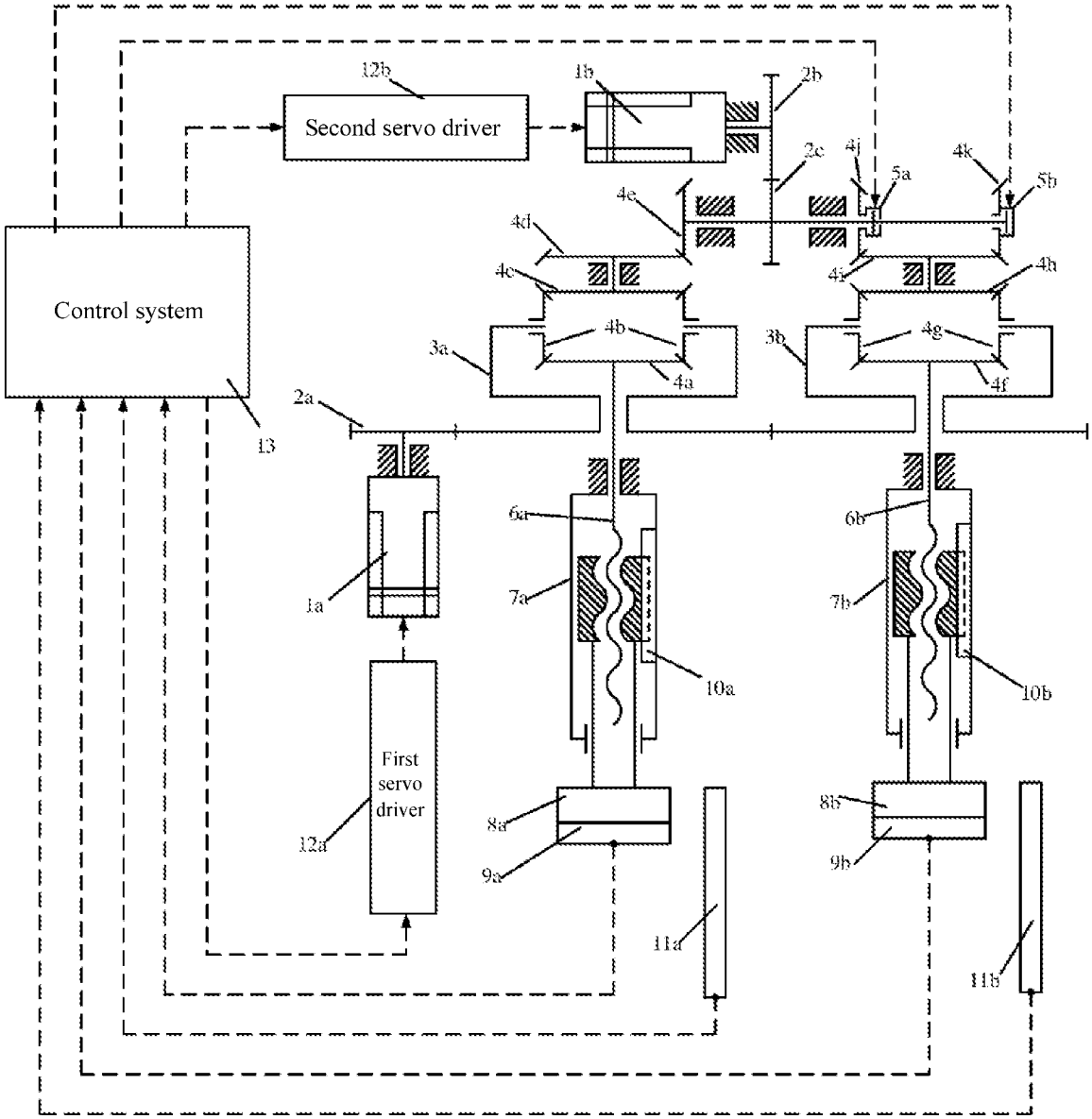
Second servo driver
Control system
First servo driver
12b
1b
2b
2c
4j
5a
4k
5b
4e
4d
4c
4i
4h
4b
4g
3a
3b
4a
4f
2a
13
6a
6b
1a
7a
7b
10a
10b
12a
8a
8b
9a
9b
11a
11b

ENERGY-SAVING DOUBLE-MOTOR DOUBLE-STATION SCREW PRESS

CROSS-REFERENCE TO RELATED APPLICATIONS

This application is a continuation of International Application No. PCT/CN2019/078683, filed on Mar. 19, 2019, which claims the priority benefit of China Patent Application No. 201810326690.8, filed on Apr. 12, 2018. The contents of the above identified applications are incorporated herein by reference in their entireties.

TECHNICAL FIELD

The present disclosure relates to a double-motor double-station screw press. During a normal operation of the screw press, left side and right side mechanisms can work symmetrically, and when the left side and right side mechanisms are no-load, only one motor works, and when any one of the mechanisms is loaded, the double motors work simultaneously.

BACKGROUND

Forming processing is widely used due to its advantages of high production efficiency, material saving, and high processing quality. Mechanical presses have advantages of stable transmission and high control accuracy and will occupy an important position in the future press market with the improvement of factory automation.

Due to the forming characteristics of the press, its motor operates at high energy efficiency only during a short pressing process. At other stages, the motor has lower energy efficiency and there is a large amount of energy loss. Where a slider rises and falls frequently according to a working rhythm when the press works, the gravitational potential energy and kinetic energy are converted into thermal energy for dissipation during the falling process, which constitutes an important part of energy loss.

SUMMARY

In order to avoid the above-mentioned shortcomings of the prior art, the present disclosure designs an energy-saving double-motor double-station screw press which can switch to a single motor to work when the required power of the press is small; and switch to double motors to work simultaneously when the required power of the press is large. This press is designed to have two pressing mechanisms, which can also improve not only energy efficiency but also working efficiency.

To solve the technical problems, the present disclosure adopts the following technical solution:

an energy-saving double-motor double-station screw press of the present disclosure has the following structural features:

two sets of screw pair mechanisms are respectively arranged on both sides of the press, where a first screw pair mechanism includes a first cylinder, a first lead screw, a first slider, and a first anti-rotation apparatus, and a second screw pair mechanism includes a second cylinder, a second lead screw, a second slider, and a second anti-rotation apparatus; a first differential gear train is formed by a first bevel gear, a second bevel gear, a third bevel gear, and a first turning arm, the first differential gear train takes the third bevel gear and the first turning arm as input ends and the first bevel gear as an output end; and a second differential gear train is formed by a sixth bevel gear, a seventh bevel gear, an eighth bevel gear, and a second turning arm, the second differential gear train takes the eighth bevel gear and the second turning arm as input ends and the sixth bevel gear as an output end;

the first lead screw is driven by a resultant movement which is synthesized by a first motor and a second motor through the first differential gear train; the second lead screw is driven by a resultant movement which is synthesized by the first motor and the second motor through the second differential gear train; and a steering switching apparatus is provided between the second motor and the second differential gear train, so that the steering switching apparatus can drive the eighth bevel gear in the second differential gear train to switch between two different rotation directions, under the condition that a rotation direction of the second motor is not changed;

a first displacement sensor and a second displacement sensor respectively detect and obtain displacements and speeds of the first slider and the second slider, and transmit the information to a control system; a first pressure sensor and a second pressure sensor detect a pressure in a pressing process, and transmit this pressure information to the control system; the control system controls the first motor and the second motor respectively through a first servo driver and a second servo driver, and receives a motor feedback signal; and the first motor and the second motor are both servo motors.

The structural features of the energy-saving double-motor double-station screw press of the present disclosure also lie in: the first motor is directly connected to a first gear, the first gear drives the first turning arm to rotate, the second motor is directly connected to a second gear, the second gear is engaged with a third gear, the third gear is coaxial with a fifth bevel gear, the fifth bevel gear drives the third bevel gear to rotate through a fourth bevel gear; inputs of the third bevel gear and the first turning arm are combined into an output of the first bevel gear through the first differential gear train, the first bevel gear is coaxial with the first lead screw, a rotation movement of the first lead screw is converted into an up-and-down linear movement of the first slider through the first screw pair mechanism; simultaneously, the first turning arm drives the second turning arm to rotate; the steering switching apparatus is provided with a tenth bevel gear and an eleventh bevel gear coaxially with the third gear, and a first clutch is provided between the third gear and the tenth bevel gear, and a second clutch is provided between the third gear and the eleventh bevel gear; the tenth bevel gear and the eleventh bevel gear are engaged with a ninth bevel gear at different positions; when the first clutch is engaged and the second clutch is disengaged, the third gear drives the ninth bevel gear to rotate through the tenth bevel gear; when the first clutch is disengaged and the second clutch is engaged, the third gear drives the ninth bevel gear to rotate through the eleventh bevel gear, the ninth bevel gear drives the eighth bevel gear to rotate, inputs of the eighth bevel gear and the second turning arm are combined into an output of the sixth bevel gear through the second differential gear train, the sixth bevel gear is coaxial with the second lead screw, and a rotation movement of the second lead screw is converted into an up-and-down linear movement of the second slider through the second screw pair mechanism.

The structural features of the energy-saving double-motor double-station screw press of the present disclosure also lie in:

an initial position is set according to the following process:

Step 1: Moving the second slider to a limit position A by working of the first motor, the second motor being not working;

Step 2: Keeping the first motor working, making the second motor work simultaneously, the first clutch being disengaged and the second clutch being engaged, and formula (1) being satisfied, so that the second slider is kept at the limit position A and does not move, and the first slider moves towards a limit position B, and the first motor and the second motor stop working when the first slider reaches the limit position B, to complete setting of the initial position; the limit positions A and B are different limit positions:

$$n_{1b} = -\frac{2n_{1a} \cdot z_{2a} \cdot z_{2c} \cdot z_{4i}}{z_{2b} \cdot z_{3b} \cdot z_{4k}}, \quad (1)$$

$n_{1a}$ is a rotational speed of the first motor (1*a*);
$n_{1b}$ is a rotational speed of the second motor (1*b*);
$z_{2a}$ is the number of teeth of the first gear (2*a*);
$z_{2b}$ is the number of teeth of the second gear (2*b*);
$z_{2c}$ is the number of teeth of the third gear (2*c*);
$z_{3b}$ is the number of teeth of the second turning arm (3*b*);
$z_{4i}$ is the number of teeth of the ninth bevel gear (4*i*); and
$z_{4k}$ is the number of teeth of the eleventh bevel gear (4*k*).

The structural features of the energy-saving double-motor double-station screw press of the present disclosure also lie in: a mode of a no-load operation of the press is set as: the first clutch is engaged and the second clutch is disengaged; the first motor does not work and is locked by a brake; the second motor works alone to complete a no-load stroke of the press. The no-load operation refers to that: the first screw pair mechanism and the second screw pair mechanism are both in a no-load state; the first slider moves upward, and the second slider moves downward correspondingly; or the first slider moves downward and the second slider moves upward correspondingly.

The structural features of the energy-saving double-motor double-station screw press of the present disclosure also lie in: a mode of a load operation of the press is set as: the first clutch is engaged and the second clutch is disengaged; the first motor and the second motor work simultaneously, output powers of the first motor and the second motor are combined on the first differential gear train and the second differential gear train, respectively, thereby controlling operations of the first slider and the second slider to complete a load stroke of the press. The load operation refers to that: Any screw pair mechanism in the press is in a pressing process.

The structural features of the energy-saving double-motor double-station screw press of the present disclosure also lie in: according to a ratio of no-load operation power to load operation power of the press, a power allocation of the first motor and the second motor is performed by formula (2):

$$\frac{p_{1a}}{p_{1b}} = \frac{p_{load}}{p_{idle}}, \quad (2)$$

$p_{1a}$ is rated power of the first motor;
$p_{1b}$ is rated power of the second motor;
$p_{idle}$ is the no-load operation power of the press; and
$p_{load}$ is the load operation power of the press;

Compared with the prior art, the present disclosure has the following beneficial effects:

1. The present disclosure connecting two screw pair mechanisms to two motors respectively through different differential gear trains, to implement the complementary actions of execution units of the press, realizing linkage of double execution units. A single execution unit can implement the processing actions twice in one cycle, improving the reusing of kinetic and potential energy and the working efficiency of the press.

2. When the two screw pair mechanisms of the present disclosure are both no-load, since the required power of the press is relatively low, only one motor works, and the load of the motor is in a high-efficiency region, improving the energy efficiency. When any screw pair mechanism is loaded, since the required power of the press is relatively high, two motors work simultaneously, and the two motors are in high-efficiency regions and have high energy efficiencies, respectively. Meanwhile, the powers of the two motors are combined, so that the installed powers of the motors can be reduced under the condition of meeting the maximum required power of the press.

BRIEF DESCRIPTION OF DRAWINGS

FIG. 1 is a schematic diagram of mechanical structures and system of a press of the present disclosure;

The reference signs are as follows:

1*a*—first motor; 1*b*—second motor; 2*a*—first gear; 2*b*—second gear; 2*c*—third gear; 3*a*—first turning arm; 3*b*—second turning arm; 4*a*—first bevel gear; 4*b*—second bevel gear; 4*c*—third bevel gear; 4*d*—fourth bevel gear; 4*e*—fifth bevel gear; 4*f*—sixth bevel gear; 4*g*—seventh bevel gear; 4*h*—eighth bevel gear; 4*i*—ninth bevel gear; 4*j*—tenth bevel gear; 4*k*—eleventh bevel gear; 5*a*—first clutch; 5*b*—second clutch; 6*a*—first lead screw; 6*b*—second lead screw; 7*a*—first cylinder; 7*b*—second cylinder; 8*a*—first slider; 8*b*—second slider; 9*a*—first pressure sensor; 9*b*—second pressure sensor; 10*a*—first anti-rotation apparatus; 10*b*—second anti-rotation apparatus; 11*a*—first displacement sensor; 11*b*—second displacement sensor; 12*a*—first servo driver; 12*b*—second servo driver; 13—control system.

DESCRIPTION OF EMBODIMENTS

Referring to FIG. 1, the structure of the energy-saving double-motor double-station screw press in this embodiment is as follows:

Two sets of screw pair mechanisms are respectively arranged on both sides of the press, where a first screw pair mechanism is formed by a first cylinder 7*a*, a first lead screw 6*a*, a first slider 8*a*, and a first anti-rotation apparatus 10*a*, and a second screw pair mechanism is formed by a second cylinder 7*b*, a second lead screw 6*b*, a second slider 8*b* and a second anti-rotation apparatus 10*b*; a first differential gear train is formed by a first bevel gear 4*a*, a second bevel gear 4*b*, a third bevel gear 4*c*, and a first turning arm 3*a*, and input ends of the first differential gear train are the third bevel gear 4*c* and the first turning arm 3*a*, and an output end thereof is the first bevel gear 4*b*; and a second differential gear train is formed by a sixth bevel gear 4*f*, a seventh bevel gear 4*g*, an eighth bevel gear 4*h*, and a second turning arm 3*b*, and input ends of the second differential gear train are the eighth bevel gear 4*h* and the second turning arm 3*b* and an output end thereof is the sixth bevel gear 4*f*.

The first lead screw 6*a* is driven by a resultant movement which is synthesized by a first motor 1*a* and a second motor 1*b* through the first differential gear train; the second lead screw 6*b* is driven by a resultant movement which is synthesized by the first motor 1*a* and the second motor 1*b* through the second differential gear train; a steering switching apparatus is set between the second motor 1*b* and the second differential gear train, so that the steering switching apparatus can drive the eighth bevel gear 4*h* in the second differential gear train to switch between two different rotation directions, under the condition that the steering of the second motor 1*b* is not changed.

A first displacement sensor 11*a* and a second displacement sensor 11*b* respectively detect and obtain the displacements and speeds of the first slider 8*a* and the second slider 8*b*, and transmit the information to a control system 13; a first pressure sensor 9*a* and a second pressure sensor 9*b* detect a pressure in a pressing process, and transmit the pressure information to the control system 13; the control system 13 controls the first motor 1*a* and the second motor 1*b* respectively through a first servo driver 12*a* and a second servo driver 12*b*, and receives a motor feedback signal; the first motor 1*a* and the second motor 1*b* are both servo motors, and the power of the first motor 1*a* is not lower than that of the second motor 1*b*.

As shown in FIG. 1, in this embodiment, the first motor 1*a* is directly connected to a first gear 2*a*, the first gear 2*a* drives the first turning arm 3*a* to rotate, the second motor 1*b* is directly connected to a second gear 2*b*, the second gear 2*b* is engaged with a third gear 2*c*, the third gear 2*c* is coaxial with a fifth bevel gear 4*e*, the fifth bevel gear 4*e* drives a third bevel gear 4*c* to rotate through a fourth bevel gear 4*d*, inputs of the third bevel gear 4*c* and the first turning arm 3*a* are combined into an output of the first bevel gear 4*a* through the first differential gear train, the first bevel gear 4*a* is coaxial with the first lead screw 6*a*, the rotation movement of the first lead screw 6*a* is converted into an up-and-down linear movement of the first slider 8*a* through the first screw pair mechanism. Simultaneously, the first turning arm 3*a* drives the second turning arm 3*b* to rotate; the steering switching apparatus sets a tenth bevel gear 4*j* and an eleventh bevel gear 4*k* coaxially with the third gear 2*c*, sets a first clutch 5*a* between the third gear 2*c* and the tenth bevel gear 4*j*, and sets a second clutch 5*b* between the third gear 2*c* and the eleventh bevel gear 4*k*; the tenth bevel gear 4*j* and the eleventh bevel gear 4*k* are engaged with a ninth bevel gear 4*i* at different positions. When the first clutch 5*a* is engaged and the second clutch 5*b* is disengaged, the third gear 2*c* drives the ninth bevel gear 4*i* to rotate through the tenth bevel gear 4*j*. When the first clutch 5*a* is disengaged and the second clutch 5*b* is engaged, the third gear 2*c* drives the ninth bevel gear 4*i* to rotate through the eleventh bevel gear 4*k*, and the ninth bevel gear 4*i* drives the eighth bevel gear 4*h* to rotate, inputs of the eighth bevel gear 4*h* and the second turning arm 3*b* are combined into an output of the sixth bevel gear 4*f* through the second differential gear train, and the sixth bevel gear 4*f* is coaxial with the second lead screw 6*b*, a rotation movement of the second lead screw 6*b* is converted into an up-and-down linear movement of the second slider 8*b* through the second screw pair mechanism.

Regarding to the energy-saving double-motor double-station screw press in this embodiment, an initial position is set according to the following process:

Step 1: Moving the second slider 8*b* to a limit position A by using the first motor 1*a*, and the second motor 1*b* does not work;

Step 2: keeping the first motor 1*a* working and making the second motor 1*b* work simultaneously, the first clutch 5*a* being disengaged and the second clutch 5*b* being engaged, and formula (1) being satisfied, so that the second slider 8*b* is kept at the limit position A and does not move, and the first slider 8*a* moves towards a limit position B, and works of the first motor 1*a* and the second motor 1*b* are stopped when the first slider 8*a* reaches the limit position B, to complete setting of the initial position; the limit positions A and B are different limit positions:

$$n_{1b} = -\frac{2n_{1a} \cdot z_{2a} \cdot z_{2c} \cdot z_{4i}}{z_{2b} \cdot z_{3b} \cdot z_{4k}}, \tag{1}$$

$n_{1a}$ is a rotational speed of the first motor (1*a*);
$n_{1b}$ is a rotational speed of the second motor (1*b*);
$z_{2a}$ is the number of teeth of the first gear (2*a*);
$z_{2b}$ is the number of teeth of the second gear (2*b*);
$z_{2c}$ is the number of teeth of the third gear (2*c*);
$z_{3b}$ is the number of teeth of the second turning arm (3*b*);
$z_{4i}$ is the number of teeth of the ninth bevel gear (4*i*); and
$z_{4k}$ is the number of teeth of the eleventh bevel gear (4*k*).

Regarding to the energy-saving double-motor double-station screw press in this embodiment, a no-load operation mode of the press is set as: the first clutch 5*a* is engaged and the second clutch 5*b* is disengaged, the first motor 1*a* does not work and is locked by a brake, the second motor 1*b* works alone to complete a no-load stroke of the press.

The no-load operation refers to that: the first screw pair mechanism and the second screw pair mechanism are both in a no-load state, the first slider 8*a* moves upward, and the second slider 8*b* moves downward, correspondingly; or the first slider 8*a* moves downward and the second slider 8*b* moves upward, correspondingly. During the no-load stroke, the gravity of the first slider 8*a* and the second slider 8*b* will be partially balanced, and the second motor 1*b* only needs to overcome the friction resistance of the transmission chain and the unbalanced slider gravity. By the low power characteristic of the second motor 1*b*, the energy loss is effectively reduced while meeting the requirements of completing the no-load stroke quickly.

Regarding to the energy-saving double-motor double-station screw press in this embodiment, a mode of a load operation of the press is set as: the first clutch 5*a* is engaged and the second clutch 5*b* is disengaged, the first motor 1*a* and the second motor 1*b* work simultaneously, motor output powers of the first motor 1*a* and second motor 1*b* are combined respectively on the first differential gear train and the second differential gear train, thereby controlling the operations of the first slider 8*a* and the second slider 8*b* to complete a load stroke of the press.

The load operation refers to: any one of the screw pair mechanisms in the press is in a pressing process. When the setting of an initial position of the press is completed, the two sliders are located at different limit positions; in a normal operation, the two sliders will run symmetrically and alternately complete a pressing process. In this embodiment, under the condition of meeting the highest required power of the press, the installed power of the first motor 1*a* can be reduced according to a power superposition principle of the differential gear trains.

In an specific implementation, regarding to the energy-saving double-motor double-station screw press in this embodiment, according to a ratio of no-load operation power and load operation power of the press, a power allocation of the first motor 1*a* and the second motor 1*b* is performed by formula (2):

$$\frac{p_{1a}}{p_{1b}} = \frac{p_{load}}{p_{idle}}, \tag{2}$$

$p_{1a}$ is rated power rated power of the first motor;
$p_{1b}$ is rated power of the second motor;
$p_{idle}$ is the no-load operation power of the press;
$p_{load}$ is the load operation power of the press;

In the structure shown in FIG. 1, regarding to the following rotating parts: the first gear 2*a*, the first turning arm 3*a*, the second turning arm 3*b*, the first bevel gear 4*a*, the third bevel gear 4*c*, the fourth bevel gear 4*d*, the sixth bevel gear 4*f*, the eighth bevel gear 4*h*, the ninth bevel gear 4*i*, the first lead screw 6*a*, and the second lead screw 6*b*, their rotations in the clockwise direction are uniformly defined as a forward rotation direction, according to a viewing direction from the bottom to the top; regarding to the following rotating parts: the second gear 2*b*, the third gear 2*c*, the second bevel gear 4*b*, the fifth bevel gear 4*e*, the seventh bevel gear 4*g*, the tenth bevel gear 4*j*, and the eleventh bevel gear 4*k*, their rotations in the clockwise direction are uniformly defined as a forward rotation direction, according to a viewing direction from the left to the right; regarding to the following translational parts: the first slider 8*a*, and the second slider 8*b*, a direction in which they move downward is taken as a forward direction; it is defined that a positive value is substituted when the screw pair mechanism has a right-handed pitch, and a negative value is substituted when the screw pair mechanism has a left-handed pitch. Then:

The displacement speed $v_{8a}$ of the first slider 8*a* is as shown in formula (3):

$$v_{8a} = n_{6a} \cdot p_1 = \left(-\frac{2n_{1a} \cdot z_{2a}}{z_{3a}} + \frac{n_{1b} \cdot z_{2b} \cdot z_{Ae}}{z_{2c} \cdot z_{Ad}}\right) \cdot p_1 \tag{3}$$

When the steering switching apparatus is set such that the first clutch 5*a* is engaged and the second clutch 5*b* is disengaged, and the tenth bevel gear 4*j* meshes with the ninth bevel gear 4*i*, the displacement speed $v_{8b}$ of the second slider 8*b* is as shown in formula (4):

$$v_{8b} = n_{6b} \cdot p_2 = \left(\frac{2n_{1a} \cdot z_{2a}}{z_{3b}} - \frac{n_{1b} \cdot z_{2b} \cdot z_{4j}}{z_{2c} \cdot z_{4i}}\right) \cdot p_2 \tag{4}$$

When the steering switching apparatus is set such that the first clutch is disengaged and the second clutch 5*b* is engaged, and the eleventh bevel gear 4*k* meshes with the ninth bevel gear 4*i*, the displacement speed $v_{8b}$ of the second slider 8*b* is as shown in formula (5):

$$v_{8b} = n_{6b} \cdot p_2 = \left(\frac{2n_{1a} \cdot z_{2a}}{z_{3b}} + \frac{n_{1b} \cdot z_{2b} \cdot z_{4k}}{z_{2c} \cdot z_{4i}}\right) \cdot p_2 \tag{5}$$

$v_{8a}$ is displacement speed of first slider 8*a*,
$n_{6a}$ is rotational speed of first lead screw 6*a*,
$v_{8b}$ is displacement speed of second slider 8*b*;
$n_{6b}$ is rotational speed of second lead screw 6*b*;
$n_{1a}$ is rotational speed of first motor 1*a*;
$n_{1b}$ is rotational speed of second motor 1*b*;
$p_1$ is pitch of first lead screw 6*a*;
$p_2$ is pitch of second lead screw 6*b*;
$n_{3a}$ is rotational speed of first turning arm 3*a*;
$n_{3b}$ is rotational speed of second turning arm 3*b*;
$z_{2a}$ is the number of teeth of first gear 2*a*;
$z_{2b}$ is the number of teeth of second gear 2*b*;
$z_{2c}$ is the number of teeth of third gear 2*c*;
$z_{3a}$ is the number of teeth of first turning arm 3*a*;
$z_{3b}$ is the number of teeth of second turning arm 3*b*;
$z_{2i}$ is the number of teeth of ninth bevel gear 4*i*;
$z_{2j}$ the number of teeth of tenth bevel gear 4*j*;
$z_{2k}$ is the number of teeth of eleventh bevel gear 4*k*.

What is claimed is:

1. An energy-saving double-motor double-station screw press, wherein:

two sets of screw pair mechanisms are respectively arranged on both sides of the press, where a first screw pair mechanism comprises a first cylinder (7*a*), a first lead screw (6*a*), a first slider (8*a*), and a first anti-rotation apparatus (10*a*), and a second screw pair mechanism comprises a second cylinder (7*b*), a second lead screw (6*b*), a second slider (8*b*), and a second anti-rotation apparatus (10*b*); a first differential gear train is formed by a first bevel gear (4*a*), a second bevel gear (4*b*), a third bevel gear (4*c*), and a first turning arm (3*a*), the first differential gear train takes the third bevel gear (4*c*) and the first turning arm (3*a*) as input ends and the first bevel gear (4*a*) as an output end; and a second differential gear train is formed by a sixth bevel gear (4*b*), a seventh bevel gear (4*g*), an eighth bevel gear (4*h*) and a second turning arm (3*b*), the second differential gear train takes the eighth bevel gear (4*h*) and the second turning arm (3*b*) as input ends and the sixth bevel gear (40 as an output end;

the first lead screw (6*a*) is driven by a resultant movement which is synthesized by a first motor (1*a*) and a second motor (1*b*) through the first differential gear train; the second lead screw (6*b*) is driven by a resultant movement which is synthesized by the first motor (1*a*) and the second motor (1*b*) through the second differential gear train; a steering switching apparatus is provided between the second motor (1*b*) and the second differential gear train, so that the steering switching apparatus drives the eighth bevel gear (4*h*) in the second differential gear train to switch between two different rotation directions, under the condition that a rotation direction of the second motor (1*b*) is not changed;

a first displacement sensor (11*a*) and a second displacement sensor (lib) respectively detect and obtain displacements and speeds of the first slider (8*a*) and the second slider (8*b*), and transmit the obtained information to a control system (13); a first pressure sensor (9*a*) and a second pressure sensor (9*b*) respectively detect and obtain a pressure of the first slider (8*a*) and the second slider (8*b*) in a pressing process, and transmit this pressure information to the control system (13); the control system (13) controls the first motor (1*a*) and the second motor (1*b*) respectively through a first servo driver (12*a*) and a second servo driver (12*b*), and receives a motor feedback signal; and the first motor (1*a*) and the second motor (1*b*) are both servo motors.

2. The energy-saving double-motor double-station screw press according to claim 1, wherein:

the first motor (1*a*) is directly connected to the first gear (2*a*); the first gear (2*a*) drives the first turning arm (3*a*) to rotate; the second motor (1*b*) is directly connected to a second gear (2*b*); the second gear (2*b*) is engaged with a third gear (2*c*); the third gear (2*c*) is coaxial with a fifth bevel gear (4*e*); the fifth bevel gear (4*e*) drives the third bevel gear (4*c*) to rotate through a fourth bevel gear (4*d*); inputs of the third bevel gear (4*c*) and the first turning arm (3*a*) are combined into an output of the first bevel gear (4*a*) through the first differential gear train, the first bevel gear (4*a*) is coaxial with the first lead screw (6*a*), a rotation movement of the first lead screw (6*a*) is converted into an up-and-down linear movement of the first slider (8*a*) through the first screw pair mechanism; simultaneously, the first turning arm (3*a*) drives the second turning arm (3*b*) to rotate; the steering switching apparatus is provided with a tenth bevel gear (4*j*) and an eleventh bevel gear (4*k*) coaxially with the third gear (2*c*), and a first clutch (5*a*) is provided between the third gear (2*c*) and the tenth bevel gear (4*j*), and a second clutch (5*b*) is provided between the third gear (2*c*) and the eleventh bevel gear (4*k*); the tenth bevel gear (4*j*) and the eleventh bevel gear (4*k*) are engaged with a ninth bevel gear (4*i*) at different positions; when the first clutch (5*a*) is engaged and the second clutch (5*b*) is disengaged, the third gear (2*c*) drives the ninth bevel gear (4*i*) to rotate through the tenth bevel gear (4*j*); when the first clutch (5*a*) is disengaged and the second clutch (5*b*) is engaged, the third gear (2*c*) drives the ninth bevel gear (4*i*) to rotate through the eleventh bevel gear (4*k*), the ninth bevel gear (4*i*) drives the eighth bevel gear (4*h*) to rotate, inputs of the eighth bevel gear (4*h*) and the second turning arm (3*b*) are combined into an output of the sixth bevel gear (40 through the second differential gear train, the sixth bevel gear (40 is coaxial with the second screw (6*b*), and a rotation movement of the second lead screw (6*b*) is converted into an up-and-down linear movement of the second slider (8*b*) through the second screw pair mechanism.

3. The energy-saving double-motor double-station screw press according to claim 2, wherein:

an initial position is set according to the following process:

Step 1: moving the second slider (8*b*) to a limit position A by working of the first motor (1*a*), and the second motor (1*b*) being not working;

Step 2: keeping the first motor (1*a*) working, making the second motor (1*b*) work simultaneously, the first clutch (5*a*) being disengaged and the second clutch (5*b*) being engaged, and formula (1) being satisfied, so that the second slider (8*b*) is kept at the limit position A and does not move, and the first slider (8*a*) moves towards a limit position B, and the first motor (1*a*) and the second motor (1*b*) stop working when the first slider (8*a*) reaches the limit position B, to complete setting of the initial position; the limit positions A and B are different limit positions:

$$n_{1b} = -\frac{2n_{1a} \cdot z_{2a} \cdot z_{2c} \cdot z_{4i}}{z_{2b} \cdot z_{3b} \cdot z_{4k}}, \quad (1)$$

$n_{1a}$ is a rotational speed of the first motor (1*a*);

$n_{1b}$ is a rotational speed of the second motor (1*b*);

$z_{2a}$ is the number of teeth of the first gear (2*a*);

$z_{2b}$ is the number of teeth of the second gear (2*b*);

$z_{2c}$ is the number of teeth of the third gear (2*c*);

$z_{3b}$ is the number of teeth of the second turning arm (3*b*);

$z_{4i}$ is the number of teeth of the ninth bevel gear (4*i*);

$z_{4k}$ is the number of teeth of the eleventh bevel gear (4*k*).

4. The energy-saving double-motor double-station screw press according to claim 2, wherein:

a mode of a no-load operation of the press is set as: the first clutch (5*a*) is engaged and the second clutch (5*b*) is disengaged, the first motor (1*a*) does not work and is locked by a brake, and the second motor (1*b*) works alone to complete a no-load stroke of the press;

the no-load operation refers to that: the first screw pair mechanism and the second screw pair mechanism are both in a no-load state; the first slider (8*a*) moves upward, and the second slider (8*b*) moves downward correspondingly; or the first slider (8*a*) moves downward and the second slider (8*b*) moves upward correspondingly.

5. The energy-saving double-motor double-station screw press according to claim 2, wherein:

a mode of a load operation of the press is set as: the first clutch (5*a*) is engaged and the second clutch (5*b*) is disengaged, the first motor (1*a*) and the second motor (1*b*) work simultaneously, output powers of the first motor (1*a*) and second motor (1*b*) are combined on the first differential gear train and the second differential gear train, respectively, thereby controlling operations of the first slider (8*a*) and the second slider (8*b*) to complete a load stroke of the press; the load operation refers to that: any screw pair mechanism in the press is in a pressing process.

6. The energy-saving double-motor double-station screw press according to claim 2, wherein: according to a ratio of no-load operation power to load operation power of the press, a power allocation of the first motor (1*a*) and the second motor (1*b*) is performed by formula (2):

$$\frac{p_{1a}}{p_{1b}} = \frac{p_{load}}{p_{idle}}, \quad (2)$$

$p_{1a}$ is rated power of the first motor;

$p_{1b}$ is rated power of the second motor;

$p_{idle}$ is the no-load operation power of the press; and $p_{load}$ is the load operation power of the press.

* * * * *